United States Patent [19]

Inoue

[11] Patent Number: 4,744,600

[45] Date of Patent: May 17, 1988

[54] CUSHIONING MECHANISM FOR USE WITH SEAT OF CHAIR AND INTERLOCKING CUSHIONING MECHANISM FOR SEAT AND BACKREST

[75] Inventor: Noboru Inoue, Tokyo, Japan

[73] Assignee: Itoki Co., Ltd., Ohsaka, Japan

[21] Appl. No.: 43,316

[22] Filed: Apr. 28, 1987

[30] Foreign Application Priority Data

May 6, 1986 [JP] Japan ..... 61-101915
May 6, 1986 [JP] Japan ..... 61-66908[U]

[51] Int. Cl.[4] ..... A47C 1/02

[52] U.S. Cl. ..... 297/326; 248/575; 297/300; 297/304

[58] Field of Search ..... 297/90, 91, 326, 325, 297/304, 305, 301, 300; 248/578, 575, 577

[56] References Cited

U.S. PATENT DOCUMENTS 4,018,415 2/1977 Wolters ..... 297/304
4,200,332 4/1980 Brauning ..... 297/304
4,641,885 2/1987 Brauning ..... 297/304
4,653,806 3/1987 Willi ..... 297/300
4,659,052 4/1987 Nagata ..... 248/575

FOREIGN PATENT DOCUMENTS 3322450 1/1985 Fed. Rep. of Germany ..... 297/300

*Primary Examiner*—James T. McCall
*Attorney, Agent, or Firm*—L. Lawton Rogers, III; Joseph M. Killeen

[57] ABSTRACT

A cushioning mechanism suitable for use with an office chair is disclosed. A seat frame is connected pivotally to the front of a support frame for swinging motion about the pivotal connection. The swinging motion of the seat frame is converted into the translation thereof by means of a link mechanism, and thus a cushioning member such as a coil spring incorporated in the support frame is compressed by the translation of the seat frame. Accordingly, even when the seat portion is made to swing by a large degree, the front of the seat portion is not greatly shifted in height, thereby enabling the user to sit in the chair comfortably.

5 Claims, 4 Drawing Sheets

CUSHIONING MECHANISM FOR USE WITH SEAT OF CHAIR AND INTERLOCKING CUSHIONING MECHANISM FOR SEAT AND BACKREST

BACKGROUND OF THE INVENTION

1. Field of the Invention

The present invention relates generally to a cushioning mechanism to be incorporated in a chair which is typically employed in an office, and more particularly to a cushioning mechanism for use with the seat portion of such a chair and an interlocking cushioning mechanism which is arranged to cushion the seat portion and a backrest in an interlocked manner.

2. DESCRIPTION OF THE PRIOR ART

It is well known that a typical cushioning mechanism for use with the seat portion of an office chair may include a gas spring, a coil spring, a torsion bar or various other kinds of cushioning members.

In addition, various proposals have been made with respect to an interlocking cushioning mechanism which is arranged to cushion the seat portion and a backrest of such an office chair in an interlocked manner. Such an interlocking cushioning mechanism typically includes as the cushioning member for the seat portion a gas spring, a coil spring, a torsion bar or the like, such cushioning member being interlocked with the backrest via a link mechanism such as to cushion the swinging motion of the backrest. An interlocking cushioning mechanism of this type is disclosed, for example, in U.S. Pat. No. 4,533,177 and Japanese Patent Laid-open No. 29304/1986.

Also known is a cushioning mechanism of a spring type in which it is possible to adjust the degree of cushioning, for example, the hardness or resiliency of an incorporated spring. In such a conventional spring type cushioning mechanism, however, the mechanism becomes complicated and the number of parts used is also increased, resulting in an increase in its size. In other words, such a prior-art mechanism involves the problem of including a large number of potential failure factors.

In particular, adoption of the type in which a spring is incorporated in a leg or support frame or a seat frame has the tendency to result in a complicated structure.

A previously proposed type of cushioning mechanism which is so arranged as to interlock the seat portion and the backrest also requires a complicated interlocking mechanism. Another conventionally proposed type in which the degree of cushioning, for example, the hardness or resiliency of a spring, is adjustable requires a complicated mechanism and a large number of parts, and this leads to an increase in size. Such a type therefore involves the problem of including a large number of potential failure factors.

SUMMARY OF THE INVENTION

It is therefore a first object of the present invention to provide a cushioning mechanism for the seat portion of a chair employing a coil spring or an equivalent cushioning member in which the spring or equivalent cushioning member is incorporated in a frame portion of the chair so that the resiliency of the spring or the cushioning member may be adjusted by means of a simple structure.

It is a second object of the present invention to provide an interlocking cushioning mechanism employing a cushioning member such as a spring in which the swinging motion of a seat portion is kept in interlocking relationship with that of a backrest, the cushioning member being attached via a simple structure and the replacement of the cushioning member thus being made easy.

In order to achieve the first object, the arrangement provided in accordance with the present invention comprises:

a support frame including a pillar and a leg portion to which the seat portion of a chair is mounted and having an upper end portion which is tilted toward the front edge of the seat portion;

a cushioning member such as a coil spring incorporated in the support frame and having a stopper member at its front end;

a seat frame bearing thereon the seat portion of a chair, the seat frame having a front end portion connected pivotally via horizontal shaft to the upper end portion of the support frame in which the cushioning member is incorporated, the horizontal shaft extending substantially parallel to the front and rear edges of the seat portion and allowing for vertically swinging motion of the seat portion in an approximately horizontal plane;

a lever block integral with the seat frame, the lever block projecting downwardly from the portion of the seat frame to which the upper end portion of the seat frame is pivotably connected and serving to cause motion of the cushioning member;

a tie rod disposed in the lower portion of the lever block for pivotal motion at its front end, the tie rod being inserted at its rear end portion into the support frame incorporating the cushioning member so as to support the rear end of the cushioning member at the rear end of the tie rod;

a receiver member disposed in the front end portion of the support frame for supporting the cushioning member, the receiver member being capable of being moved forwardly and rearwardly of the seat portion; and a wedge member disposed adjacent to the receiver member for vertical movement in the front end portion of the support frame so as to allow for forward and rearward motion of the receiver member, thereby enabling adjustment of the cushioning effect provided by the cushioning member.

In order to achieve the second object, the present invention provides a chair including: a seat frame for supporting a seat portion; a support frame having an upper portion tilted forwardly of the seat portion, the lower side of the front of the seat frame being pivotably connected to the upper end portion of the support frame via a horizontal shaft which extends substantially parallel to the front and rear edges of the seat portion; and a cushioning member held under compression between the lower side of the seat portion and a corresponding portion of the support frame for cushioning the swinging motion of the seat portion about the horizontal shaft, wherein the improvement comprises:

an interlocking link having a lower end portion pivotably connected to the support frame by a shaft provided substantially parallel to the aforesaid horizontal shaft;

a guide opening horizontally formed in the lower portion of a side of the seat frame, the interlocking link being supported at its upper end portion by the guide opening for slidable movement therealong; and a coupling link for connecting the upper end portion of the interlocking link and the lower end portion of a backrest supporting member, the backrest supporting member being pivotable at its lower end portion so that it can be reclined rearwardly of the seat frame.

These and other objects, features and advantages of the present invention will become apparent from the following detailed descriptions of preferred embodiments thereof taken in conjunction with the accompanying drawings.

DESCRIPTION OF THE PREFERRED EMBODIMENTS

The preferred embodiments of the present invention will be described below with reference to the accompanying drawings.

Figure 1:
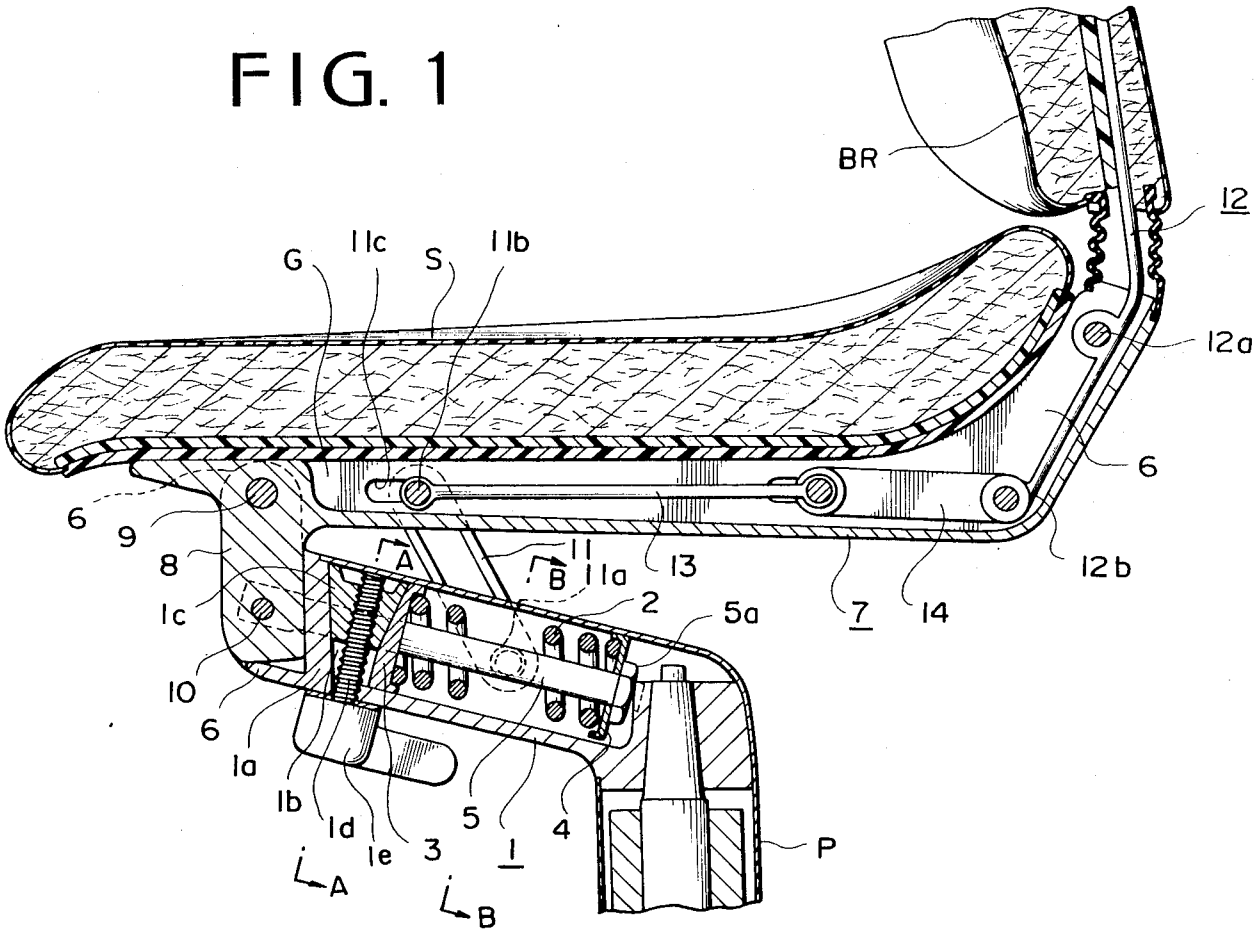
FIG. 1 is a side elevational view, in cross section, of the essential portion of a preferred embodiment of the present invention.
Figure 2:
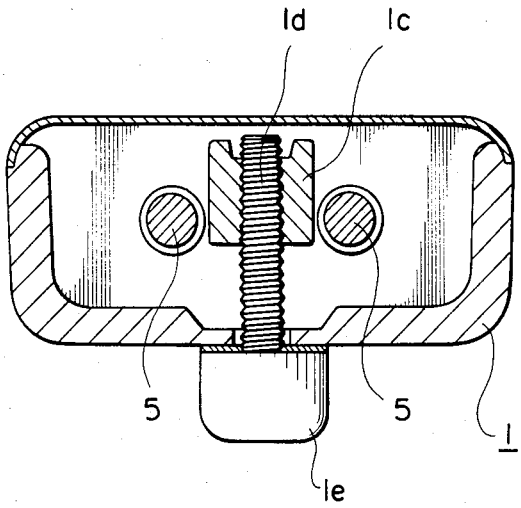
FIG. 2 is a cross-sectional view taken along the line A—A of FIG. 1.
Figure 3:
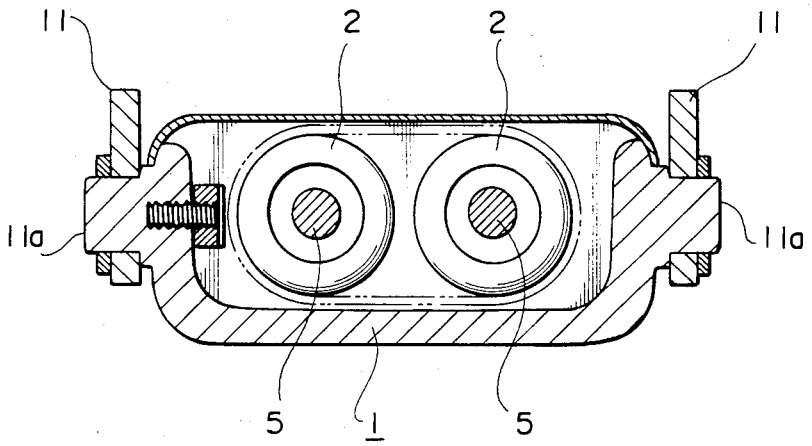
FIG. 3 is a cross-sectional view taken along the line B—B of FIG. 1.

FIG. 1 is a side elevational view, in cross section, of a cushioning mechanism constituting a first preferred embodiment of the present invention. FIGS. 2 and 3 are respectively cross-sectional views taken along the lines A—A and B—B of FIG. 1.

Referring to these Figures, a support frame indicated generally at 1 includes an upright pillar P having a tubular structure, and the pillar P has an upper end portion tilted at an angle of about 85 degrees in the horizontal direction (or forwardly of the seat). The support frame 1 has a box-like shape in cross section as shown in FIGS. 2 and 3, and the front end of the support frame 1 is formed in the shape of a vertical block. The front end of the support frame 1 is formed as a pivotal connection 6 of a seat frame 7 which will be described later.

Two coil springs 2 are inserted into the support frame 1. Spring receivers 3 and 4 each having an elliptical shape in front elevation are respectively disposed in contact with the front and rear ends of the respective coil springs 2. Two tie rods 5 are respectively fitted into the two coil springs 2, and each of the tie rods 5 has a rear end fixed at 5*a* to the spring receiver 4 and a front end extending through the spring receiver 3 into the pivotal connection 6 of the seat frame 7.

A lid 1*a* is formed at the front end of the support frame 1 (rearwardly of the pivotal connection 6), and a tapered gap 1*b* is defined between the facing surfaces of the spring receiver 3 and the lid 1*a*. A wedge member 1*c* is inserted into the gap 1*b* and is clamped between the facing surfaces. A screw stem 1 is screwed into the wedge member 1*c*.

In this arrangement, rotation of the stem 1*d* causes vertical movement of the wedge member 1*c* in the gap 1*b*, and this vertical movement alters the interval between the spring receivers 3 and 4. In other words, the degree of compression of the springs 2 is capable of being adjusted. A lever 1*e* is provided so as to cause rotation of the stem 1*d*.

A seat portion S is mounted on the upper side of the seat frame 7 which substantially passes through the horizontal. A lever block 8 projects downwardly from the lower surface of the front of the seat frame 7 corresponding to the pivotal connection 6 of the support frame 1. A gap G is defined between the lower side of the seat portion S and the upper side of the seat frame 7 for incorporation of an interlocking mechanism which will be described later.

The aforesaid block 8 is pivotably connected to the pivotal connection 6 via a horizontal shaft 9 which extends substantially parallel to the front and rear edges of the seat portion S. The respective front ends of the tie rods 5 are pivotally connected to the lower portion of the block 8 by a shaft 10 provided parallel to the shaft 9.

In consequence, a space is defined between the lower side of the seat frame 7 and a corresponding portion of the support frame 1, the space serving as a stroke space which allows for the swinging motion of the seat portion S.

An interlocking link 11 is provided between the support frame 1 and the seat frame 7 in such a manner as to tilt forwardly of the seat portion S in the aforesaid stroke space. The interlocking link 11 has a lower end pivotally connected to the support frame 1 by a shaft 11*a* parallel to the shaft 9. An upper end portion 11*b* of the interlocking link 11 is slidably moved along a guide opening 11*c* which is constituted by a slot horizontally formed in the seat frame 7.

Therefore, when the seat portion S is caused to swing about the axis of the shaft 9 clockwise as viewed in FIG. 1, the upper end portion 11*b* of the interlocking link 11 is made to slide along the guide opening 11*c* forwardly of the seat portion S (to the left as viewed in FIG. 1).

A frame member 12 is disposed so as to support a backrest BR, and the lower end portion of the frame member 12 is pivotally connected at 12*a* to the rear end portion of the seat frame 7. This pivotal connection 12*a* supports the backrest BR so that it may be reclined with respect to the seat portion S.

In this manner, a lower end 12*b* of the frame member 12 is connected to the upper end of the interlocking link 11, so that the swinging motion of the seat portion S is transmitted to the backrest BR through the interlocking link 11 and the frame member 12. The backrest BR is thus made to swing in interlocking relationship with the seat portion S. On the other hand, if the backrest BR is reclined, the seat portion S can be made to vertically swing. In this case, the degree of inclination of the backrest BR which causes the interlocking swinging motion can be freely adjusted by adjusting the distance between the pivotal connection 12*a* and the lower end 12*b* of the frame member 12.

In this embodiment, two coupling links 13 and 14 are interposed between the interlocking link 11 and the backrest supporting frame 12. The coupling link 14 is disposed so as to smoothly transmit the motion of the interlocking link 11 to the backrest supporting frame 12 in the gap G which is remarkably narrow. Therefore, if the gap G is sufficiently large, the interlocking link 14 is not needed.

It is to be noted that the number of the springs 2 is not limited to two. Of course, two or more springs may be used, and use of a single spring could also be suitable as occasion demands. In these cases, it is a matter of course that the support frame 1 is formed having a cross-sectional shape corresponding to the number and shape of the spring or springs incorporated in the support frame 1. Incidentally, the cushioning member may be constituted by any suitable means other than the aforesaid spring, for example, a gas spring.

In addition, the adjustment mechanism for the compression degree of the springs 2 may be disposed at the rear end of the springs 2, that is, on the side of the spring receiver 4.

The operation of the aforesaid embodiment will be described below.

When a user sits in the seat portion S having the aforesaid cushioning mechanism and a load is thereby applied thereto, the seat frame 7 will be rotated about the axis of the shaft 9 clockwise as viewed in FIG. 1. This motion causes rotation of the lever block 8 about the axis of the shaft 9 clockwise as viewed in FIG. 1 and at the same time moves the lever block 8 at its lower portion including the shaft 10 forwardly of the seat portion S (to the left as viewed in FIG. 1).

It follows that the rotation of the block 8 forwardly of the seat portion S pulls the tie rod 5 connected pivotally to the shaft 10 in the forward direction (to the left in FIG. 1). In consequence, the coil spring 2 is compressed toward the spring receiver 3 by the motion of the spring receiver 4.

Simultaneously, the aforesaid clockwise rotation of the seat frame 7 causes the front end portion 11*b* of the interlocking link 11 to advance forwardly along the guide opening 11*c* (to the left in FIG. 1). Since the backrest supporting frame 12 is connected to the interlocking link 11 via the coupling links 13 and 14, the support frame 12 is pulled at its lower end 12*b* forwardly of the seat portion S (to the left in FIG. 1) about the axis of the pivotal connection 12*a*. Thus, the backrest BR is made to tilt about the axis of the pivotal connection 12*a* in the clockwise direction, that is, rearwardly of the chair.

Accordingly, while the load applied to the seat portion S is being cushioned by the resiliency of the springs 2 which are compressed by the load, it swings (depresses) the seat portion S in the clockwise direction and at the same time tilts the backrest BR rearwardly of the chair. This mechanism serves as an interlocking reclining mechanism for the backrest BR in cooperation with the aforesaid cushioning mechanism of the seat portion S.

Figure 4:
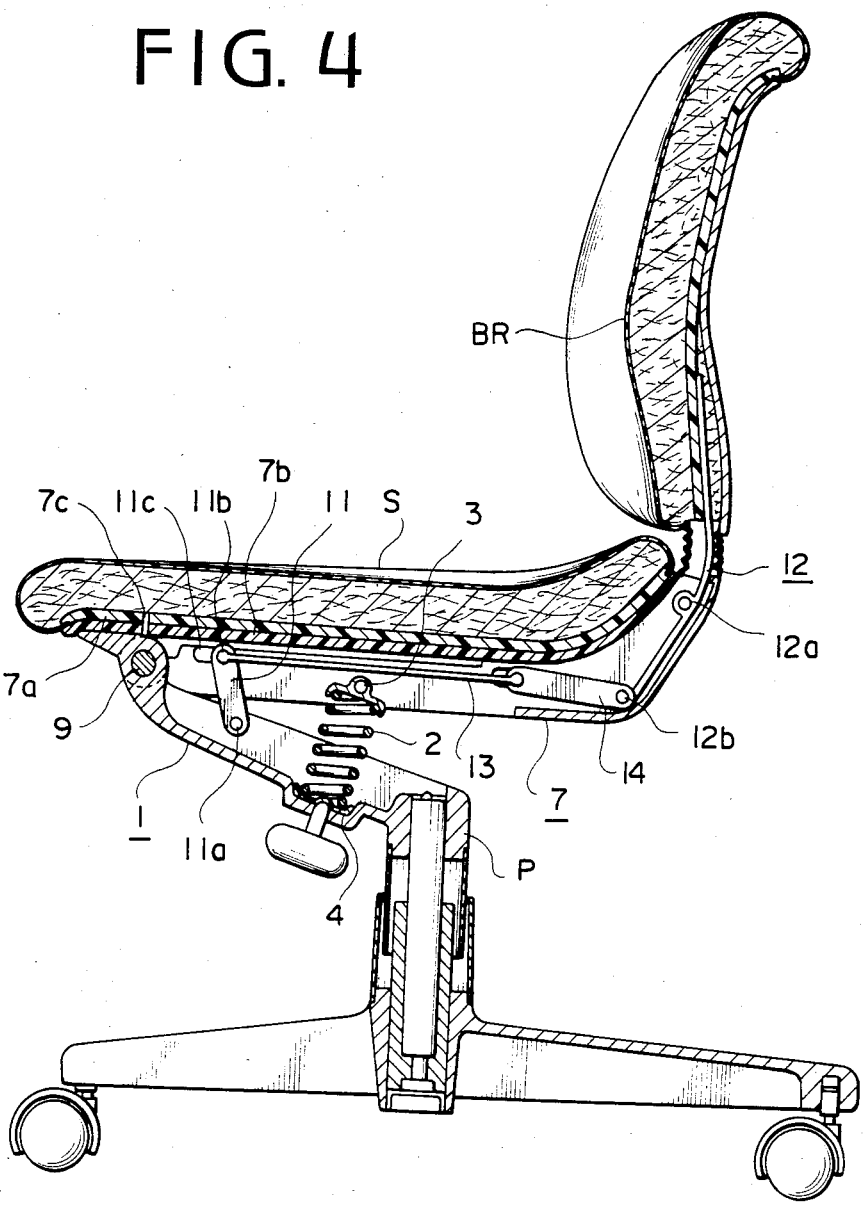
FIG. 4 is a side elevational view, in partial cross section, of another preferred embodiment of the present invention in its upright position.
Figure 5:
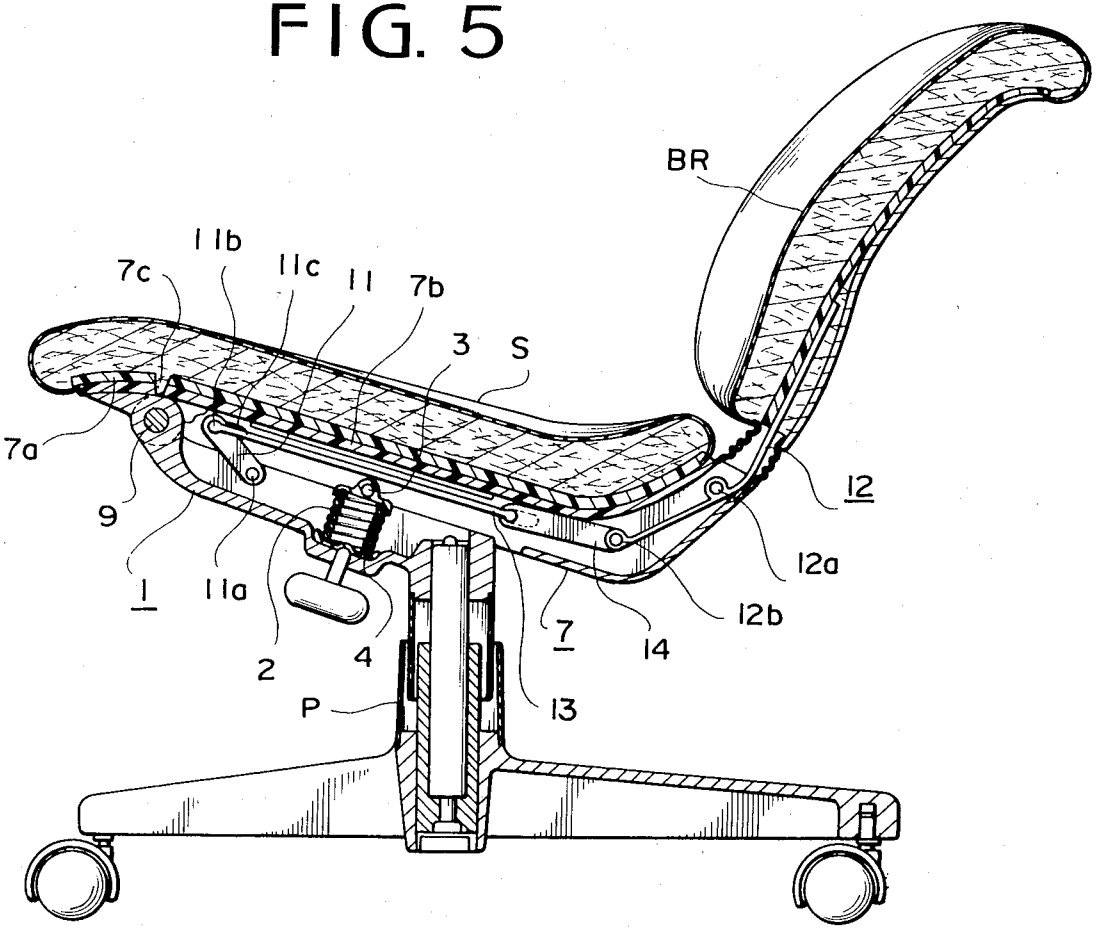
FIG. 5 is a side elevational view, in partial cross section, of the embodiment shown in FIG. 4 but in its reclined position.

FIGS. 4 and 5 are respectively side elevational views of the second preferred embodiment of the present invention. In FIGS. 4 and 5, reference numerals similar to those of FIG. 1 are used to identify similar elements.

As shown in FIGS. 4 and 5, the cushioning mechanism constituting the second embodiment differs from the cushioning mechanism shown in FIG. 1 in respect of the manner of attachment of the coil spring 2 in the cushioning mechanism of the seat portion S, the compression mechanism thereof and the structure of the front of the seat frame 7.

In the second embodiment, a single coil spring 2 is provided in the stroke space defined between the support frame 1 and the seat frame 7 which allows for the swinging motion of the seat frame 7. In other words, the coil spring 2 is supported directly between the both frames 1 and 7. The downward swivelling motion (depression) of the seat frame 7 directly compresses the coil spring 2, so that the swivel motion is cushioned. In addition, since the front of the seat frame 7 is pivotally connected to the front of the support frame 1 by a shaft 9, the lever block 8 used in the first embodiment is not needed.

The seat frame 7 includes a rear portion 7*b* disposed rearwardly from the pivot shaft 9 and a front end portion 7*a* disposed forwardly therefrom. Only the rear portion 7*b* of the seat frame 7 is adapted to swing about the pivot shaft 9. The front end portion 7*a* is separated at 7*c* from the rear portion 7*b*, and is fixed to the top of a bracket-shaped portion of the support frame 1 which is formed forwardly of the shaft 9.

With this arrangement, the front end portion 7*a* of the seat frame 7 never moves even during swinging motion of the rear portion 7*b* about the shaft 9 (refer to FIG. 5). This arrangement therefore provides advantage in that, since the depression of the seat portion S involves no dislocation of the front end portion 7*a* thereof, the user can sit in the chair comfortably.

The two-piece structure of the seat frame 7 which is divided into front and rear portions can, of course, be applied to a chair of the type having the structure shown in FIG. 1.

As can be appreciated from the foregoing descriptions of the embodiments, the cushioning mechanism is arranged in the following manner in accordance with the present invention. The seat frame is connected pivotally to the front edge of the support frame for swinging motion about the pivotal connection. The swinging motion of the seat frame is converted into the translation thereof by means of the link mechanism, and thus the cushioning member constituted by the coil spring incorporated in the support frame is compressed by the translation of the seat frame. Accordingly, even when the seat portion is made to swing by a large degree, the front of the seat portion is not greatly shifted in height, thereby enabling the user to comfortably sit in the chair. In addition, since no cushioning member such as a spring is exposed to the exterior, the freedom to select a shape and form of construction to suit such a specific chair design can be extended.

Also, since a cushioning member such as a spring is incorporated in the support frame, chairs other than the so-called revolving chair typically used in offices, for example, four-legged chairs and various other types of chair, can also be provided with a cushioning mechanism by adopting a relatively simple structure.

Moreover, since the cushioning member such as the spring incorporated in the support frame includes an adjustment mechanism by means of which the compression of the cushioning member can be easily adjusted, the user can adjust the cushioning effect of the cushioning member as desired.

In accordance with the present invention, the cushioning mechanism is arranged in such a manner that the seat frame is connected pivotally to the front edge of the support frame for swinging motion about the pivotal connection, the swinging motion of the seat frame being converted into the translation thereof by means of the link mechanism, and thus the cushioning member constituted by the coil spring incorporated in the support frame is compressed by the translation of the seat frame. The swinging motion is transmitted to the backrest support frame through simple coupling mechanisms provided in the seat frame. Accordingly, since neither the cushioning member, such as a spring, nor the coupling link is exposed to the exterior, the freedom to select a shape and form of construction to suit such a specific chair design can be extended.

Also, since the cushioning member, such as a spring, and the coupling link may be incorporated in the support frame, chairs other than the so-called revolving chair that is typically used in offices, for example, four-legged chairs or chairs of the type which have a support frame and a seat frame can be provided with the aforesaid interlocking cushioning mechanism by adopting a relatively simple structure.

As will be readily understood from the foregoing, the present invention provides a remarkably effective cushioning mechanism for the seat portion as well as an interlocking cushioning mechanism in which the seat portion and the backrest are interlocked with each other.

What is claimed is:

1. A cushioning mechanism adapted for use with a seat portion of a chair, comprising:

a support frame of a pillar-like shape to which the seat portion of a chair is mounted and having an upper end portion which is tilted toward the front edge of the seat portion;

a cushioning member such as a coil spring incorporated in said support frame and having a stopper member at its front end;

a seat frame bearing thereon the seat portion of a chair, said seat frame having a front end portion connected pivotally via a horizontal shaft to the upper end portion of said support frame in which said cushioning member is incorporated, said horizontal shaft extending substantially parallel to the front and rear edges of the seat portion and allowing for vertically swinging motion of the seat portion in an approximately horizontal plane;

a lever block integral with said seat frame, said lever block projecting downwardly from the portion of said seat frame to which the upper end portion of said support frame is pivotably connected and serving to cause motion of said cushioning member;

a tie rod disposed in a lower portion of said lever block for pivotal motion at its front end, said tie rod being inserted at its rear end portion into said support frame incorporating said cushioning member so as to support the rear end of said cushioning member at the rear end of said tie rod;

a receiver member disposed in the front end portion of the support frame for supporting the cushioning member, the receiver member being capable of being moved forwardly and rearwardly of the seat portion; and a wedge member disposed adjacent to said receiver member for vertical movement in the front end portion of said support frame so as to allow for vertical motion of said receiver member, thereby enabling adjustment of the cushioning effect provided by the cushioning member.

2. In an interlocking cushioning mechanism for a seat portion and a backrest for use in a chair including: a seat frame for supporting a seat portion; a support frame having an upper portion tilted forwardly of said seat portion, the lower side of the front of said seat frame being pivotably connected to the upper end portion of said support frame via a horizontal shaft extending substantially parallel to the front and rear edges of the seat portion; and a cushioning member such as a spring held under compression between the lower side of said seat portion and a corresponding portion of said support frame for cushioning the swinging motion of the seat portion about said horizontal shaft, the improvement comprising:

an interlocking link having a lower end portion pivotably connected to said support frame by a shaft provided substantially parallel to said horizontal shaft;

a guide opening horizontally formed in a lower portion of a side of said seat frame, said interlocking link being supported at its upper end portion by said guide opening for slidable movement therealong; and a coupling link for connecting the upper end portion of said interlocking link and the lower end portion of a backrest supporting member, said backrest supporting member being pivotable at its lower end portion so that it can be reclined rearwardly of said seat frame.

3. An interlocking cushioning mechanism for a seat portion and a backrest according to claim 2, wherein said cushioning member held under compression between said seat frame and said support frame is supported at its one end in the interior of said support frame.

4. An interlocking cushioning mechanism for a seat portion and a backrest according to claim 2 further comprising:

a lever block projecting from said seat frame and integral with said seat frame at a location of said seat frame which is connected pivotally to said support frame; and a tie rod connected pivotally at its one end to a lower portion of said lever block and connected at its other end to the rear end of said cushioning member which is incorporated at its rear portion in said seat frame, wherein the swinging motion of said seat frame is converted into the compressive action of said cushioning member.

5. Apparatus for use with a chair having a seat portion, comprising;

seat frame for bearing said seat portion, having a front and a rear and having attaching means only on the front of said seat frame;

support frame having an upper end portion for mounting said seat frame thereon at said attaching means;

cushioning means internal to said upper end portion and having a front corresponding to the front of said seat frame for resiliently maintaining said seat frame at a predetermined angle relative to said upper end portion;

lever means integral with said attaching means and pivotably connected to the front of said cushioning means for engaging said cushioning means; and pivot means for connecting said lever means to said upper end portion, and for forming an axis that remains stationary relative to said support frame and to said seat frame, whereby said seat frame rotates about said axis with any point on said seat frame describing an arc of a circle with center on said axis.

* * * * *